United States Patent [19]

Mizoguchi et al.

[11] Patent Number: 4,793,874

[45] Date of Patent: Dec. 27, 1988

[54] PERMANENT MAGNETIC ALLOY AND METHOD OF MANUFACTURING THE SAME

[75] Inventors: Tetsuhiko Mizoguchi; Koichiro Inomata, both of Yokohama; Toru Higuchi, Tsuruoka; Isao Sakai, Yokohama, all of Japan

[73] Assignee: Kabushiki Kaisha Toshiba, Kawasaki, Japan

[21] Appl. No.: 11,609

[22] Filed: Feb. 6, 1987

Related U.S. Application Data

[62] Division of Ser. No. 773,547, Sep. 9, 1985, Pat. No. 4,664,724.

[30] Foreign Application Priority Data

Sep. 14, 1984 [JP] Japan ..... 59-191810
Mar. 30, 1985 [JP] Japan ..... 60-66848
Mar. 30, 1985 [JP] Japan ..... 60-66849

[51] Int. Cl.[4] ..... H01F 1/02

[52] U.S. Cl. ..... 148/103; 148/105; 419/12; 419/19; 419/20; 419/29; 419/38

[58] Field of Search ..... 148/103, 104, 105; 419/12, 19, 29, 38

[56] References Cited

U.S. PATENT DOCUMENTS 4,601,875 7/1986 Yamamoto et al. ..... 419/23

FOREIGN PATENT DOCUMENTS 0101552 2/1984 European Pat. Off. .
0106948 5/1984 European Pat. Off. .

*Primary Examiner*—John P. Sheehan
*Attorney, Agent, or Firm*—Oblon, Fisher, Spivak, McClelland & Maier

[57] ABSTRACT

A permanent magnetic alloy essentially consists of 10 to 40% by weight of R, 0.1 to 8% by weight of boron, 50 to 300 ppm by weight of oxygen and the balance of iron, where R is at least one component selected from the group consisting of yttrium and the rare-earth elements.

An alloy having this composition has a high coercive force $_IH_C$ and a high residual magnetic flux density and therefore has a high maximum energy product.

9 Claims, 3 Drawing Sheets

PERMANENT MAGNETIC ALLOY AND METHOD OF MANUFACTURING THE SAME

This is a division of application Ser. No. 773,547, filed Sept. 9, 1985, now U.S. Pat. No. 4,664,724.

BACKGROUND OF THE INVENTION

The present invention relates to a permanent magnetic alloy containing a rare-earth element and iron and to a method of manufacturing the same.

A Co-containing alloy such as $RCo_5$ or $R_2(CoCuFeM)_{17}$ (where R is a rare-earth element such as Sm or Ce and M is a transition metal such as Ti, Zr or Hf) is known as a material for a conventional rare-earth permanent magnet. However, such a Co-containing permanent magnetic alloy has a maximum energy product $(BH)_{max}$ of 30 MGOe or less, resulting in poor magnetic characteristics. In addition, Co is relatively expensive.

A permanent magnet which uses Fe in place of expensive Co was recently developed (J. Appl. Phys. 55(6), Mar. 15, 1984). This permanent magnetic alloy is an Nd-Fe-B alloy which has a low manufacturing cost and a maximum energy product frequently exceeding 30 MGOe. However, the alloy has magnetic characteristics which vary within a wide range, in particular, a coercive force varying from 300 Oe to 10 KOe. For this reason, the alloy cannot provide stable magnetic characteristics. Such a drawback prevents advantageous industrial application of the alloy so that an iron alloy stable predetermined magnetic characteristics with excellent reproducibility has been desired.

SUMMARY OF THE INVENTION

It is an object of the present invention to provide a permanent magnetic alloy which has a high coercive force and maximum energy product, can stably maintain such good magnetic characteristics, and can be manufactured easily at low cost.

A permanent magnetic alloy according to the present invention essentially consists of 10 to 40% by weight of R, 0.1 to 8% by weight of boron, 50 to 300 ppm by weight of oxygen and the balance of iron where R is at least one component selected from yttrium and the rare-earth elements.

According to the present invention, in order to improve both coercive force $_IH_C$ and residual magnetic flux density Br, the contents of R, B and O are set to fall within prescribed ranges. The present inventors conducted studies and experiments to determine the influence of oxygen concentration on magnetic characteristics. According to the results obtained, when the oxygen concentration of an alloy exceeds 300 ppm, the coercive force $_IH_C$ is significantly decreased. As a result, the maximum energy product $(BH)_{max}$ is decreased. When the oxygen concentration is lower than 50 ppm, the pulverization time during manufacture of a permanent magnet is long and the residual magnetic flux density Br is decreased. An alloy having a prescribed composition according to the present invention has high coercive force $_IH_C$ and residual magnetic flux density Br, and other excellent magnetic characteristics and can be manufactured easily at low cost.

DETAILED DESCRIPTION OF THE PREFERRED EMBODIMENTS

The present invention will now be described in detail.

A permanent magnetic alloy according to the present invention contains 10 to 40% of R where R is at least one component selected from yttrium and rare-earth elements. The prescribed content of 10 to 40% described above is a total amount of R components. In general, the coercive force $_IH_C$ tends to decrease at high temperatures. When the content of R is less than 10%, the coercive force $_IH_C$ of the resultant alloy is low and satisfactory magnetic characteristics as a permanent magnet cannot be obtained. However, when the content of R exceeds 40%, the residual magnetic flux density Br decreases. The maximum energy product $(BH)_{max}$ is a value related to a product of the coercive force $_IH_C$ and the residual magnetic flux density Br. Therefore, when either the coercive force $_IH_C$ or residual magnetic flux density Br is low, the maximum energy product $(BH)_{max}$ is low. For these reasons, the content of R is selected to be 10 to 40% by weight.

Among rare-earth elements, neodymium (Nd) and praseodymium (Pr) are particularly effective in increasing the maximum energy product $(BH)_{max}$. In other words, Nd and Pr serve to improve both the residual magnetic flux density Br and the coercive force $_IH_C$. Therefore, selected Rs preferably include at least one of Nd and Pr. In this case, the content of Nd and/or Pr based on the total content of Rs is preferably 70% or more.

Boron (B) serves to increase the coercive force $_IH_C$. When the B content is less than 0.1% by weight, the coercive force $_IH_C$ cannot be satisfactorily increased. However, when the B content exceeds 8% by weight, the residual magnetic flux density Br is decreased too much. For these reasons, the B content is set to fall within the range of 0.1 to 8% by weight.

Figure 1:
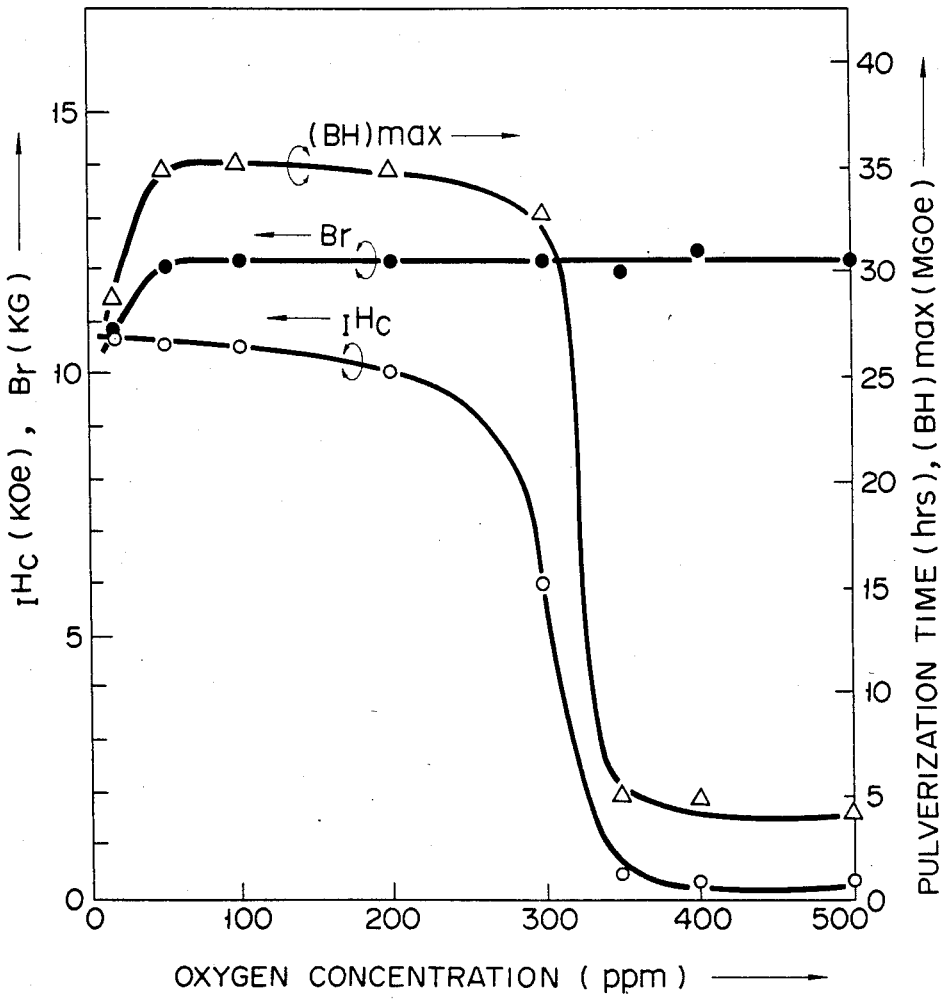
FIGS. 1 to 3 are graphs showing the magnetic characteristics as a function of oxygen concentration.

The characteristic feature of the present invention resides in the oxygen concentration being set to fall within the range of 50 to 300 ppm. In other words, the present inventors have, for the first time, demonstrated the important influence of oxygen concentration on the coercive force $_IH_C$ and residual magnetic flux density Br. FIG. 1 is a graph showing the coercive force $_IH_C$ and the residual magnetic flux density Br as a function of oxygen concentration in the alloy. When the oxygen concentration exceeds 300 ppm, the coercive force $_IH_C$ is significantly decreased. For this reason, the maximum energy product $(BH)_{max}$ as a maximum value of the product of the coercive force $_IH_C$ and the residual magnetic flux density Br is also decreased. However, when the oxygen concentration is lower than 50 ppm, the residual magnetic flux density Br is decreased, and in addition, the manufacturing cost of the alloy is increased. When the oxygen concentration of the alloy is lower than 50 ppm, the pulverization time is too long such that pulverization is practically impossible. At the same time, the particle size after pulverization is not uniform. When an alloy is compressed in a magnetic field, the orientation property is degraded and the residual magnetic flux density Br is lowered. Thus, the maximum energy product $(BH)_{max}$ is also decreased. In order to obtain a low oxygen concentration, the oxygen concentration must be accurately controlled during preparation of the alloy, resulting in a high manufacturing cost. In this manner, in order to obtain high coercive force $_IH_C$ and residual magnetic flux density Br and to achieve low manufacturing cost, the oxygen concentration of the alloy is set to fall within the range of 50 to 300 ppm by weight.

Influence mechanism of oxygen concentration on the magnetic characteristics of an alloy is postulated as follows. When an alloy is prepared, oxygen in the molten alloy is partially bonded with atoms of R or Fe (which is a main constituent) to form an oxide, and is segregated in grain boundaries of the alloy with the remaining oxygen. Since an R-Fe-B magnet is a fine particle magnet and the coercive force of such a magnet is mainly determined by a reverse magnetic domain generating magnetic field, if the alloy has defects such as an oxide and segregation, the defects become reverse magnetic domain formation sources and decrease coercive force. Therefore, when the oxygen concentration is too high, the coercive force is decreased. When only a small number of defects are present, grain boundary breakdown does not occur very frequently and the pulverization performance is lowered. Thus, if the oxygen concentration is too low, it is difficult to pulverize the alloy.

The alloy of the present invention consists of the above-mentioned components and the balance of iron. Iron serves to increase the residual magnetic flux density.

B can be parially substituted by C, N, Si, P, Ge or the like. When this substitution is performed, the sintering performance is improved, and the residual magnetic flux density Br and the maximum energy product $(BH)_{max}$ can be increased. In this case, the substitution amount can be up to 50% of the B content.

The alloy according to the present invention basically consists of R, Fe, B and O. However, the alloy of the present invention can additionally contain cobalt (Co), chromium (Cr), aluminum (Al), titanium (Ti), zirconium (Zr), hafnium (Hf), niobium (Nb), tantalum (Ta), vanadium (V), manganese (Mn), molybdenum (Mo), and tungsten (W). Co serves to increase the Curie temperature of the alloy and improve stability of magnetic characteristics against temperature change. Cr and Al serve to significantly improve corrosion resistance of the alloy. Ti, Zr, Hf, Nb, Ta, V, Mn, Mo and W serve to increase the coercive force. These components are added in a total amount of 20% by weight or less. When the total amount of such components exceeds 20% by weight, the Fe content is decreased accordingly, and the residual magnetic flux density of the alloy is decreased. As a result, the maximum energy product $(BH)_{max}$ is decreased. Ti and Al notably improve the coercive force of the alloy and the addition of these elements in only small amounts can improve the coercive force. However, when the content of these elements is less than 0.2% by weight, the increase in the coercive force $_IH_C$ is small. However, when the content of these elements exceeds 5% by weight, the decrease in the residual magnetic flux density Br is significant. Therefore, the alloy preferably contains 0.2 to 5% by weight of at least one of Ti and Al.

Co also serves to improve thermal stability of the alloy and is preferably added in the amount of 20% by weight or less. Although addition of Co in a small amount can provide an effect of improving thermal stability, Co is preferably added in the amount of 5% by weight or more.

A method of manufacturing a permanent magnet using a permanent magnetic alloy having such a composition will be described. First, an alloy of the above composition is prepared. An ingot obtained by casting the molten alloy is pulverized using a pulverizing means such as a ball mill or a jet mill. In this case, in order to facilitate sintering in a later step, the alloy is pulverized to obtain an average particle size of 2 to 10 μm. When the average particle size exceeds 10 μm, the magnetic flux density is lowered. However, it is difficult to pulverize the alloy to obtain an average particle size of less than 2 μm. If such a fine powder is obtained, the powder has a low coercive force $_IH_C$.

The powder obtained in this manner is compressed in a predetermined shape. In this process, as in a conventional process of manufacturing a normal sintered magnet, a magnetic field of about 15 KOe is applied to obtain a predetermined magnetic orientation. The powder compact is sintered at 1,000° to 1,200° C. for 0.5 to 5 hours to obtain a sintered body. In the sintering process, in order not to increase the oxygen concentration in the alloy, the compact is heated in an inert gas atmosphere such as Ar gas or in a vacuum (not more than $10^{-}$Torr).

The resultant sintered body is heated at 400° to 1,100° C. for 1 to 10 hours to perform aging, thereby improving the magnetic characteristics of the alloy. Although the aging temperature differs in accordance with the composition adopted, it is preferably 550° to 1,000° C. if the alloy contains Al and/or Ti.

A permanent magnetic alloy prepared in this manner has a high coercive force $_IH_C$ and residual magnetic flux density Br and therefore was a high maximum energy product $(BH)_{max}$. Thus, the permanent magnetic alloy of the present invention has excellent magnetic characteristics.

The present invention will be described by way of its examples below. The respective components were mixed in accordance with the compositions shown in Table 1 below. Two kilograms of each composition were melted in a water cooled copper boat in an arc furnace. In this case, the furnace interior was kept in an Ar gas atmosphere, and the oxygen concentration in the furnace was strictly controlled so as to adjust the oxygen concentration in the alloy.

TABLE 1

| | Alloy Composition (% by weight) | | | | | | | |
|---|---|---|---|---|---|---|---|---|
| | Nd | Pr | R | B | X | O | M | Fe |
| Example | | | | | | | | |
| 1 | 33.0 | — | — | 1.27 | — | 0.011 | — | bal |
| 2 | 25.0 | 5.9 | — | 1.20 | — | 0.020 | — | bal |
| 3 | 30.0 | — | Ce 2.1 | 1.18 | — | 0.025 | — | bal |
| 4 | — | 31.0 | Sm 4.0 | 1.19 | — | 0.025 | — | bal |
| 5 | 27.3 | 1.4 | Y 6.3 | 1.05 | C 0.02 | 0.016 | — | bal |
| 6 | 14.2 | 16.5 | — | 1.15 | — | 0.018 | Co 8.95 | bal |
| 7 | 7.5 | 20.6 | Ce 6.5 | 1.23 | — | 0.021 | Ti 3.66 | bal |
| 8 | 34.2 | — | — | 1.15 | — | 0.018 | Zr 6.97 | bal |
| 9 | 32.9 | — | — | 1.30 | — | 0.023 | V 3.89 | bal |
| 10 | 33.0 | — | — | 1.26 | — | 0.025 | Cr 3.97 | bal |
| Comparative Example | | | | | | | | |
| 1 | 7.0 | — | — | 1.12 | — | 0.015 | — | bal |
| 2 | 45.0 | — | — | 1.30 | — | 0.019 | — | bal |
| 3 | 13.7 | 4.5 | Ce 3.8 | 0.05 | — | 0.021 | — | bal |
| 4 | — | 29.6 | Sm 6.1 | 15.0 | — | 0.017 | — | bal |
| 5 | 32.1 | 0.9 | — | 1.25 | — | 0.003 | — | bal |
| 6 | 16.9 | 15.6 | — | 1.28 | — | 0.041 | — | bal |

The permanent magnetic alloy prepared in this manner was coarsely pulverized in an Ar gas atmosphere and then finely pulverized by a stainless steel ball mill to an average particle size of 3 to 5 μm. The resultant fine powder was packed in a predetermined press mold and compressed at a pressure of 2 ton/cm$^2$ while applying a magnetic field of 20,000 Oe. The obtained compact was sintered in an Ar gas atmosphere at 1,080° C. for 1 hour. Then, the sintered body was cooled to room temperature and was aged in a vacuum at 550° C. for 1 hour. The sintered body was then rapidly cooled to room temperture.

Table 2 below shows the magnetic characteristics (the residual magnetic flux density Br, the coercive force $_IH_C$, and the maximum energy product $(BH)_{max}$) of the permanent magnets prepared in this manner.

TABLE 2

| | Magnetic Characteristics | | |
|---|---|---|---|
| | Br(KG) | $_IH_C$(KOe) | (BH)max (MGOe) |
| Example | | | |
| 1 | 12.3 | 10.5 | 35.2 |
| 2 | 13.1 | 9.3 | 41.2 |
| 3 | 12.5 | 11.9 | 37.9 |
| 4 | 11.8 | 6.5 | 34.0 |
| 5 | 11.9 | 7.7 | 33.6 |
| 6 | 12.2 | 8.1 | 34.4 |
| 7 | 11.5 | 12.0 | 32.6 |
| 8 | 11.9 | 11.5 | 34.6 |
| 9 | 11.9 | 10.6 | 34.4 |
| 10 | 11.6 | 8.9 | 30.6 |
| Comparative Example | | | |
| 1 | 14.2 | 1.6 | 14.8 |
| 2 | 8.3 | 6.5 | 16.9 |
| 3 | 13.5 | 0.8 | 7.7 |
| 4 | 6.9 | 7.4 | 10.1 |
| 5 | 10.9 | 12.4 | 28.1 |
| 6 | 12.8 | 0.1 | 1.1 |

As can be seen from Table 2, the alloys in the Examples of the present invention all have high residual magnetic flux density Br and coercive force $_IH_C$ and high maximum energy product $(BH)_{max}$ as compared to those of alloys of Comparative Examples. When compared with the alloys of the Comparative Examples, the alloys of the Examles of the present invention have superior magnetic characteristics represented by the maximum energy product and ease in manufacture represented by pulverization time.

Subsequently, respective components were mixed in the amounts of 34.6% by weight of Nd, 1.2% by weight of B, 0.7% by weight of Al, and the balance of Fe to prepare alloys having different oxygen concentrations. Each coarse powder was prepared, and compressed. The resultant compact was sintered in an Ar gas atmosphere at 1,030° C. for 1 hour and was rapidly cooled. The compact was aged in a vacuum at 600° C. for 1 hour and was then rapidly cooled to room temperature.

Figure 2:
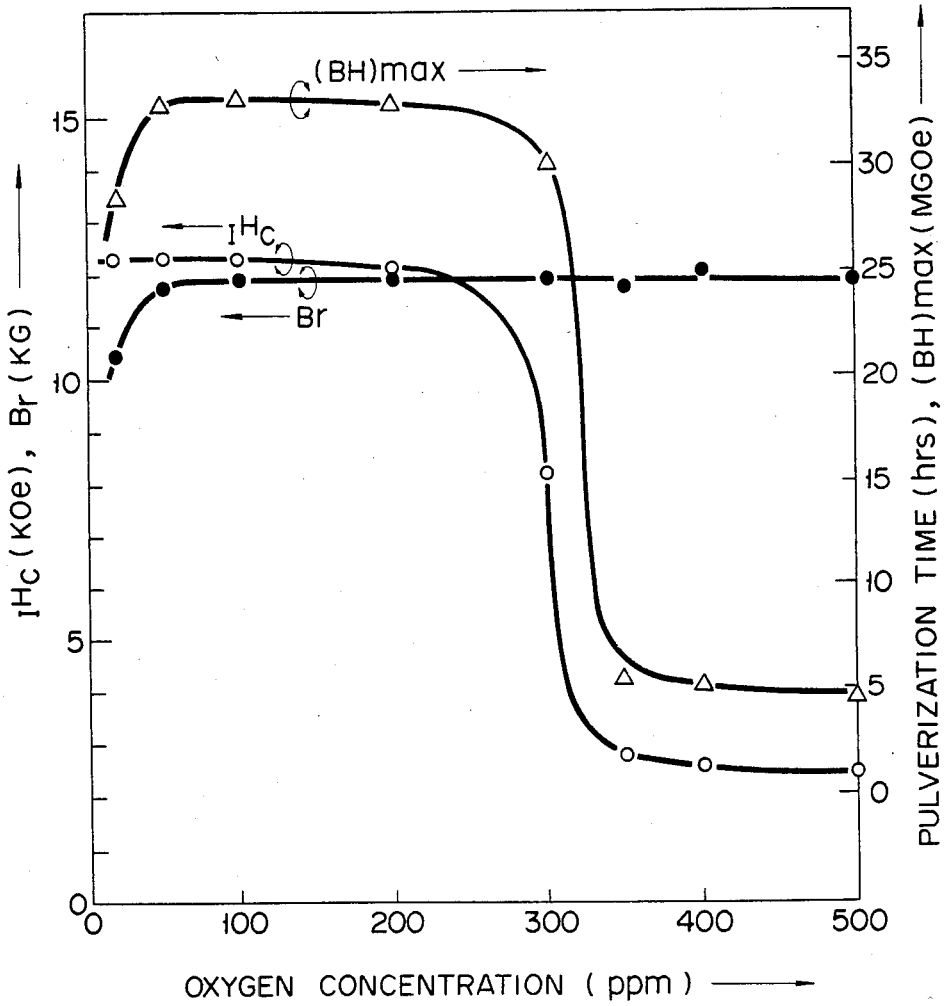

FIG. 2 shows the residual magnetic flux density Br, the coercive force $_IH_C$, and the maximum energy product $(BH)_{max}$ as a function of oxygen concentration in the permanent magnetic alloys.

As can be seen from FIG. 2, the magnetic characteristics of the permanent magnet largely depend on the oxygen concentration in the alloy. Thus, when the oxygen concentration is less than 0.005% by weight, orientation performance in a magnetic field is impaired. Thus, the residual magnetic flux density Br is also decreased. However, when the oxygen concentration exceeds 0.03% by weight, the coercive force is significantly decreased. Therefore, in a composition wherein the oxygen concentration is less than 0.005% by weight or more than 0.03% by weight, a high maximum energy product $(BH)_{max}$ cannot be obtained.

Following the above process, a permanent magnetic alloy was prepared having a composition of 33.2% by weight of Nd, 1.3% by weight of B, 14.6% by weight of Co, 0.8% by weight of Al, 0.03% by weight of oxygen and the balance of iron.

The resultant permanent magnetic alloy was pulverized, compressed and sintered in a similar manner. The sintered alloy was aged at 600° C. for 1 hour and was thereafter rapidly cooled.

The alloy had a coercive force $_IH_C$ of 11 KOe, a maximum energy product $(BH)_{max}$ of 35 MGOe and a Br temperature coefficient of −0.07%/°C.

Respective components were mixed in the amounts of 33% by weight of Nd, 1.3% by weight of B, 1.5% by weight of Ti, and the balance of Fe to prepare alloys having different oxygen concentrations. Each compact of the powder was prepared in a similar manner to that described above. The resultant compact was sintered in an Ar gas atmosphere at 1,080° C. for 1 hour and was rapidly cooled to room temperature. Thereafter, aging was performed in a vacuum at 800° C. for 1 hour and the sintered body was again rapidly cooled to room temperature.

Figure 3:
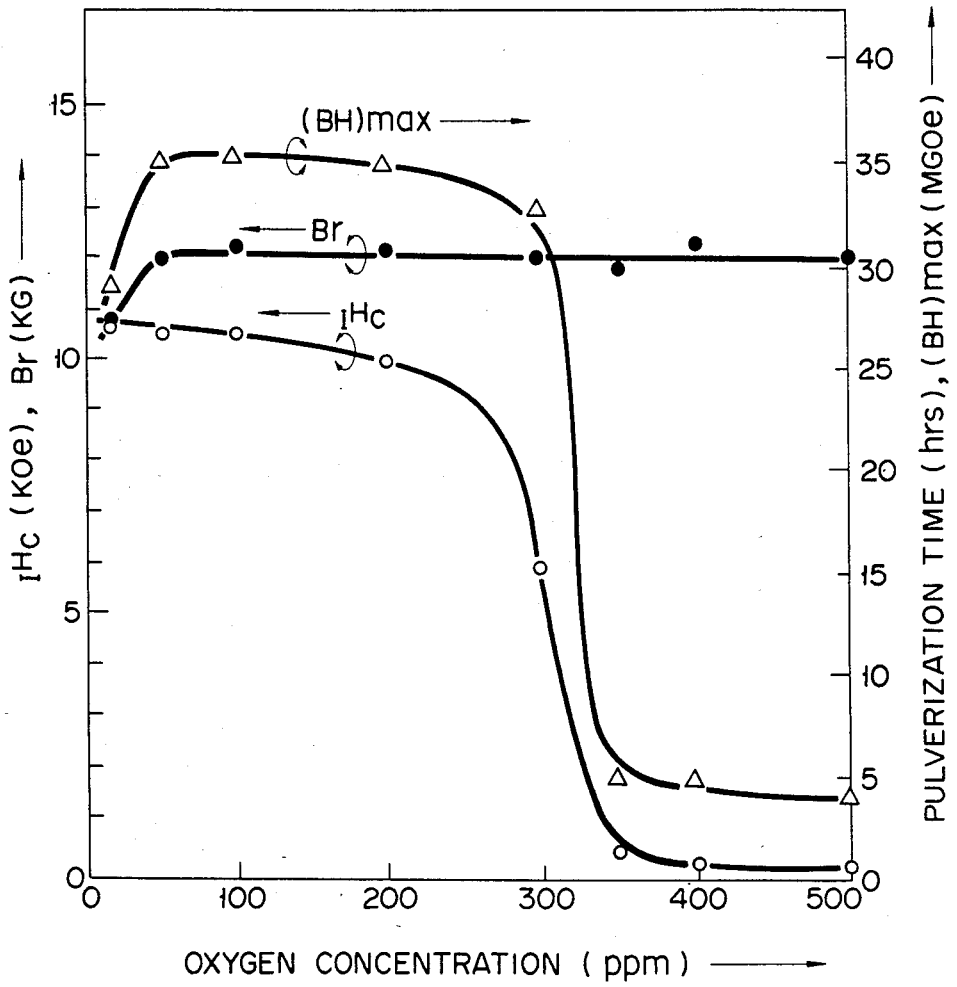

FIG. 3 shows the residual magnetic flux density Br, the coercive force $_IH_C$, and the maximum energy product $(BH)_{max}$ as a function of oxygen concentration in the permanent magnetic alloy.

As can be seen from FIG. 3, the magnetic characteristics of the permanent magnet largely depend on the oxygen concentration in the alloy. Thus, when the oxygen concentration is less than 0.005% by weight, since the orientation performance of the magnet in a magnetic field is degraded, the residual magnetic flux density Br is decreased. However, when the oxygen concentration exceeds 0.03% by weight, the coercive force is considerably decreased. Therefore, with a composition wherein the oxygen concentration is below 0.005% by weight or exceeds 0.03% by weight, the coercive force is much impaired. With such a composition, a high maximum energy product $(BH)_{max}$ cannot be obtained.

Following a similar process, a permanent magnetic alloy was prepared which had a composition consisting of 33% by weight of Nd, 1.1% by weight of B, 14.0% by weight of Co, 2.3% by weight of Ti, 0.03% by weight of O and the balance of Fe.

The resultant permanent magnetic alloy was pulverized, compressed and sintered in a similar manner to that described above.

The sample after sintering was aged at 800° C. and was rapidly cooled. The maximum energy product of the sintered body was found to be 38 MGOe. The sintered body had a Br temperature coefficient of −0.07%/°C.

What is claimed is:

1. A method of manufacturing a permanent magnet, comprising the steps of:

melting a raw material essentially consisting of 10 to 40% by weight of R, 0.1 to 8% by weight of boron, 50 to 300 ppm by weight of oxygen and the balance of iron, where R is at least one component selected from the group consisting of yttrium and rare-earth elements;

casting a melt of the raw material to obtain a block;

pulverizing the block to a powder of an average particle size of 2 to 10 μm;

compressing the powder while applying a magnetic field; and sintering a resultant compact at a temperature of 1,000° to 1,200° C. for 0.5 to 5 hours.

2. A method according to claim 1, wherein the raw material further includes not more than 20% by weight of at least one element selected from the group consisting of cobalt, chromium, aluminum, titanium, zirconium, hafnium, niobium, tantalum, vanadium, manganese, molybdenum, and tungsten.

3. A method according to claim 2, wherein the raw material further includes not more than 20% by weight of cobalt.

4. A method according to claim 3, wherein the raw material further includes 5 to 20% by weight of cobalt.

5. A method according to claim 1, wherein the raw material further includes not more than 5% by weight of at least one of aluminum and titanium.

6. A method according to claim 5, wherein the raw material further includes 0.2 to 5% by weight of at least one of aluminum and titanium.

7. A method according to claim 1, wherein the raw material further includes not more than 5% by weight of cobalt and not more than 5% by weight of at least one of aluminum and titanium.

8. A method according to claim 1, wherein the raw material further includes 5 to 20% by weight of cobalt and 0.2 to 5% by weight of at least one of aluminum and titanium.

9. A method according to claim 8, further comprising aging the sintered body at a temperature of 400° to 1,100° C. for 1 to 10 hours.

* * * * *